United States Patent [19]

Bristol

[11] Patent Number: 4,590,407

[45] Date of Patent: May 20, 1986

[54] SCALE ILLUMINATION LAMP CONTROL CIRCUIT FOR AN OSCILLOSCOPE

[75] Inventor: Lloyd R. Bristol, Tigard, Oreg.

[73] Assignee: Tektronix, Inc., Beaverton, Oreg.

[21] Appl. No.: 576,591

[22] Filed: Feb. 3, 1984

[30] Foreign Application Priority Data

Mar. 18, 1983 [JP] Japan ..... 58-38525[U]

[51] Int. Cl.[4] ..... H05B 39/04; H05B 37/02

[52] U.S. Cl. ..... 315/208; 315/205; 315/53; 315/307; 315/311; 315/362

[58] Field of Search ..... 315/208, 205, 51, 52, 315/53, 71, 311, 362, 307

[56] References Cited

U.S. PATENT DOCUMENTS

| | | | |
|---|---|---|---|
| 3,404,311 | 10/1968 | Ruppert | 315/362 X |
| 3,903,454 | 9/1975 | Matsui et al. | 315/311 X |
| 3,906,292 | 9/1975 | Takahashi | 315/208 |
| 3,938,000 | 2/1976 | Higashide | 315/208 X |
| 4,029,991 | 6/1977 | Schultz | 315/208 X |
| 4,321,509 | 3/1982 | Miyaji et al. | 315/208 X |
| 4,358,714 | 11/1982 | Sechler et al. | 315/208 X |

FOREIGN PATENT DOCUMENTS

| | | | |
|---|---|---|---|
| 615013 | 12/1926 | France | 315/311 |

*Primary Examiner*—David K. Moore
*Assistant Examiner*—Vincent DeLuca
*Attorney, Agent, or Firm*—George T. Noe

[57] ABSTRACT

A lamp control circuit particularly suited for scale illumination in cathode-ray tube display devices provides stabilized lamp control impervious to temperature fluctuations for either constant or pulsed operating modes.

3 Claims, 5 Drawing Figures

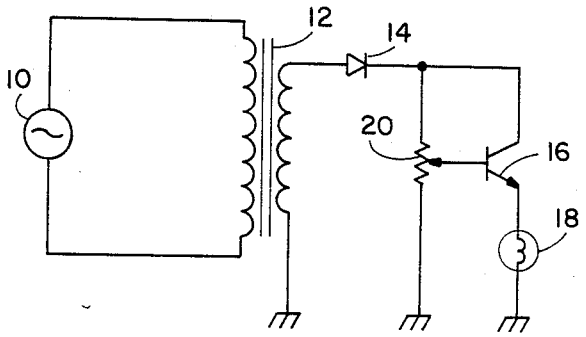
FIG. 1
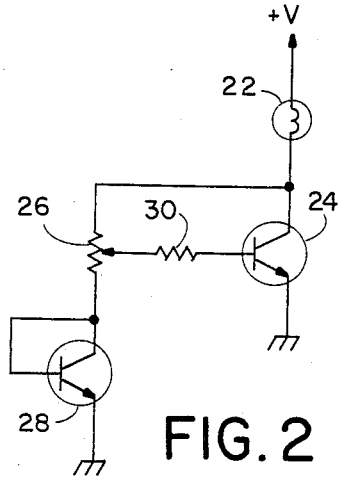
FIG. 2
FIG. 3
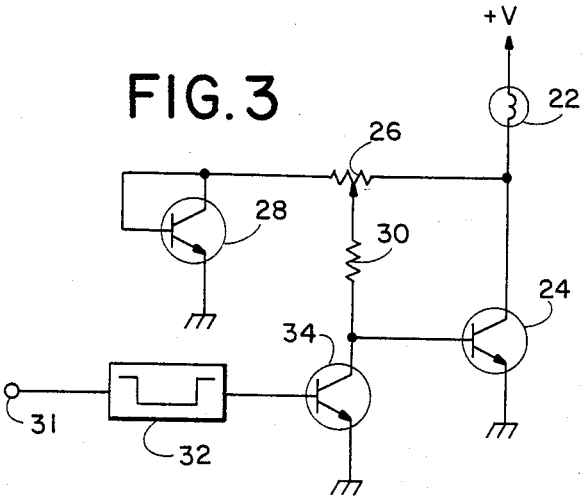

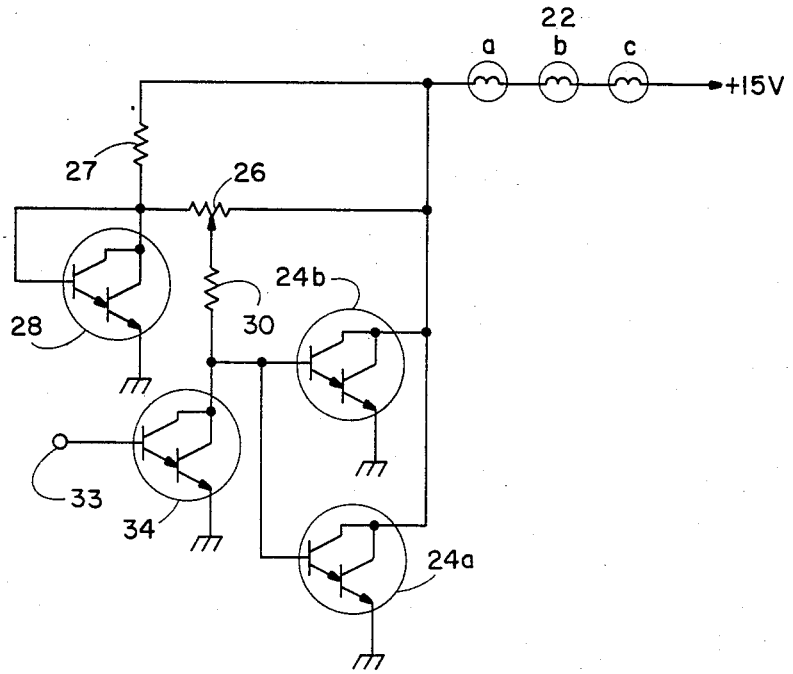
22
a
b
c
+15V
27
26
24b
28
30
33
34
24a
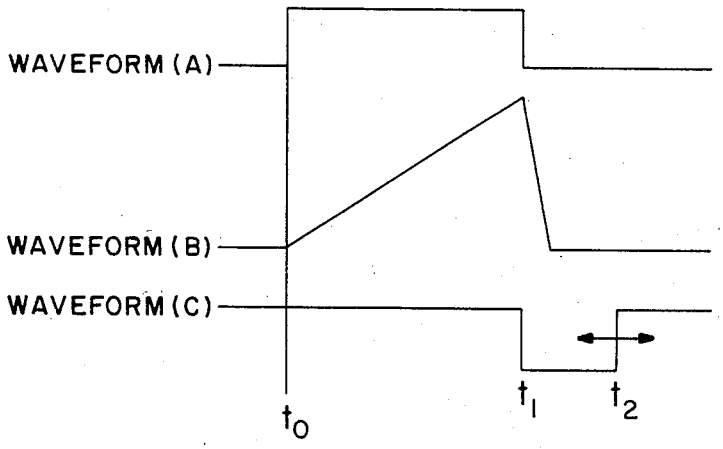
WAVEFORM (A)
WAVEFORM (B)
WAVEFORM (C)
$t_0$
$t_1$
$t_2$

SCALE ILLUMINATION LAMP CONTROL CIRCUIT FOR AN OSCILLOSCOPE

BACKGROUND OF THE INVENTION

Quantitative signal waveform measurement instruments such as oscilloscopes, spectrum analyzers, television waveform monitors, vector scopes, etc. utilize a cathode ray tube (CRT) for displaying the signal on a phosphor screen. A specially designed graticule scale or grid which is well suited to particular measurement applications is provided either internally or externally on the screen for quantitative measurement. Such graticule scales are selectively illuminated by one or more incandescent lamps provided at the edge of the CRT faceplate. The lamps are continuously controlled to provide constant or pulsed light output particularly adapted for different ambient light conditions, or for taking photographs of the displayed waveform in the single sweep mode of operation.

One typical prior art lamp control circuit disclosed in Japanese utility model publication No. 28690/72 assigned to the assignee of this invention is shown in FIG. 1 AC input voltage from AC power supply 10 is applied to the primary winding of transformer 12 and a low voltage induced in the secondary winding is rectified by diode 14 before being applied across potentiometer 20 and a series combination of the collector-emitter junction of transistor 16 and lamp 18. The controllable voltage on the wiper of potentiometer 20 is applied to the base of transistor 16. The emitter current of transistor 16 defines the lamp current of incandescent lamp 18. The lamp current is, of course, a function of the base bias current under control of potentiometer 20.

This prior art lamp control circuit is useful because no resistor is connected in series with lamp 18, thereby minimizing the power consumption and production cost. The lamp current may be controlled over a range from zero to a predetermined large current by using a low-power dissipation, less-expensive potentiometer 20. However, it is difficult to maintain the lamp current constant due to the base-to-emitter voltage ($V_{BE}$), which is temperature dependent. In addition, there is no provision for switching the lamp current between zero and some certain value at a fast rate needed for trace photography.

SUMMARY OF THE INVENTION

The lamp control apparatus according to this invention includes a series combination of at least one lamp and one or more parallel transistors connected between a voltage source and a reference potential source. A potentiometer is connected between the collector of the transistor and a reference potential source by way of a semiconductor junction. The voltage on the wiper arm of the potentiometer is applied by way of a resistor to the base of the transistor. Preferably, connected between the base and emitter of the transistor is another switching transistor to selectively turn the first mentioned transistor on and off depending on a logic control signal applied to the base of the switching transistor. Each transistor may be a Darlington type transistor.

It is therefore an object of this device to provide a stabilized lamp control apparatus.

It is another object of this device to provide a lamp control apparatus to maintain the lamp current constant under different temperatures.

It is yet another object of this device to provide a lamp control apparatus capable of switching the lamp current at a fast speed.

It is still another object of this device to provide a scale illumination control circuit for an oscilloscope or the like.

Other objects, advantages, and features of the present invention will become obvious to those skilled in the art upon a reading of the following description when taken in conjunction with the accompanying drawings.

BRIEF DESCRIPTION OF THE DRAWINGS

FIG. 1 is a schematic of conventional lamp control circuit;

FIG. 2 is a simplified circuit diagram to show the principle of the lamp control circuit according to this invention;

FIG. 3 is a circuit schematic of another embodiment of the lamp control circuit according to this invention;

FIG. 4 is a circuit schematic of a practical embodiment of this device; and

FIG. 5 shows operational waveforms to explain the lamp control circuits of FIGS. 3 and 4.

DETAILED DESCRIPTION OF THE INVENTION

Referring now to FIG. 2, shown is a simplified circuit of this comprising a single incandescent lamp 22 and an NPN transistor 24 connected serially between a positive voltage source +V and a reference potential source or ground. A potentiometer 26 is connected by way of diode-connected transistor 28 between the collector of transistor 24 and ground and a resistor 30 is coupled between the wiper arm of potentiometer 26 and the base of transistor 24. The positive voltage (+V) applied to the upper terminal of lamp 22 is several volts and the resistance of potentiometer 26 is preferably one kilohm or higher.

In operation, transistor 24 is biased just to its non-conductive state when the wiper arm of potentiometer 26 is set to one extreme or the lower end because the voltage developed across diode-connected transistor 28 just matches the turn-off point of transistor 24. It should be noted that transistor 24 is maintained non-conducting at this wiper arm position regardless of ambient temperatures. The lamp current is, therefore, determined by the current in resistor 26 and diode-connected transistor 28, which is insufficient to illuminate lamp 22. When the potentiometer wiper arm is moved upward, the increased wiper arm potential will provide corresponding base current of transistor 24, thereby continuously increasing the lamp current to make lamp 22 increasingly brighter. As the base drive current of transistor 24 increases, the collector voltage tends to decrease or pull down toward the ground potential. This increases the voltage drop across lamp 22 to illuminate it even brighter. However, the connection of the upper end of potentiometer 26 to the collector of transistor 24 provides a negative feedback loop to stabilize the base drive current of transistor 24, thereby holding the lamp illumination level constant at the selected setting of lamp control potentiometer 26. The base drive current becomes the maximum level when the wiper arm is set to the other extreme or the upper position. The resistance of resistor 30 and the current amplification factor beta ($\beta$) of transistor 24 will determine the illumination level of lamp 22.

Shown in FIG. is a simplified schematic of another embodiment of this device including lamp switching capability. This embodiment differs from FIG. 2 in the addition of control terminal 31, triggerable monostable multivibrator 32 or controllable timing circuit and switching transistor 34. A switch trigger signal is applied to control terminal 31 to trigger timing circuit 32 that normally generates a logical high level but provides a negative pulse of a controllable pulse duration. The collector-emitter of switching transistor 34 is connected between the base and emitter of transistor 24. The base drive current of transistor 24 is essentially shunted by switching transistor 34 as long as transistor 34 remains conducting, regardless of the wiper arm settings. During the logical low period in the base voltage of transistor 34, however, transistor 24 turns on, conducting the stabilized collector current to illuminate lamp 22.

FIG. 4 is a circuit schematic of a practical embodiment of the lamp control apparatus according to this invention. This embodiment is similar to FIG. 3 but differs therefrom in several respects which are described below. First, three series connected lamps 22*a*, 22*b* and 22*c* are employed. Second, all transistors are Darlington configuration to provide higher current amplification factor. Third, two parallel transistors 24*a* and 24*b* are used to conduct large lamp current. Lastly, fixed resistor 27 having a relatively lower resistance than that of potentiometer 26 is connected in parallel therewith for proper biasing of diodeconnected transistor 28. This circuit operates much the same way as the circuit in FIG. and no additional description is believed to be necessary. However, resistor 27 is useful to maintain the current in diode-connected transistor 28 substantially constant regardless of the setting of potentiometer wiper arm.

The embodiments shown in FIGS. 3 and 4 are particularly suited for oscilloscope scale illumination control circuit operating in a single sweep mode. This mode is frequently used for trace-photography purposes. The oscilloscope camera shutter is normally kept open until the sweep is completed after receiving a trigger pulse. The scale illumination lamp must normally be turned off to avoid excessive exposure in this mode, but enabled once after completion of the sweep signal. This technique is graphically shown in FIG. 5. The waveforms (A), (B) and (C) are respectively sweep gate pulse, a sweep ramp signal, and a switch control signal. The sweep ramp signal is triggered at time $t_o$ on receiving the trigger pulse and is reset at time $t_1$ when it reaches a predetermined maximum level. Simultaneously, the switch control signal is initiated at time $t_1$ and completed at time $t_2$. The camera shutter may be closed at time $t_2$. The pulse width of the negative switch control signal may be controllable or fixed.

As is understood from the foregoing description, various advantages of the lamp control apparatus in accordance with this invention include the stability of lamp illumination due to negative feedback circuit construction and the use of a temperature compensation transistor, the ease of switching lamp illumination between zero and selectable light outputs, and the lower cost lamp illumination circuit using commercially-available integrated circuit devices.

This invention is therefore suited for use as a scale illumination circuit for oscilloscopes and other cathode-ray tube display devices. It is to be appreciated that various changes and modifications may be made without departing from the present invention in its broadest aspects.

I claim:

1. A lamp control circuit, comprising:

a series connection of a lamp and the primary current path of a transistor connected between predetermined voltage sources;

a series connection of a potentiometer and a semiconductor junction connected between the collector and emitter of said transistor; and a resistor coupled between the wiper arm of said potentiometer and the base of said transistor;

wherein said resistor and a selectable part of said potentiometer form a negative feedback path from the collector of said transistor to the base thereof.

2. A lamp control circuit in accordance with claim 1 wherein said transistor comprises a plurality of parallel transistors.

3. A lamp control circuit in accordance with claim 1 wherein said transistor and semiconductor junction comprises Darlington transistor pairs.

* * * * *